United States Patent [19]

Closs

[11] 4,294,075

[45] Oct. 13, 1981

[54] SINGLE STAGE RANKINE AND CYCLE POWER PLANT

[76] Inventor: Joseph J. Closs, 36 Jade cres., Brampton, Ontario, Canada

[21] Appl. No.: 85,533

[22] Filed: Oct. 17, 1979

[30] Foreign Application Priority Data

Dec. 7, 1976 [CA] Canada ..... 267281

[51] Int. Cl.[3] ..... F01K 25/00

[52] U.S. Cl. ..... 60/671; 60/690; 219/10.51; 219/10.57

[58] Field of Search ..... 60/643, 645, 651, 670, 60/671, 685, 690, 721; 219/10.51, 10.55 R, 10.57, 10.65, 10.81

[56] References Cited

U.S. PATENT DOCUMENTS 2,622,184 12/1952 Johneas ..... 219/10.51 X
3,281,727 10/1966 Niebuhr et al. ..... 219/10.55 X
3,531,933 10/1970 Baldwin ..... 60/671 X
3,778,578 12/1973 Long et al. ..... 60/721 X
4,136,276 1/1979 Ashe ..... 219/10.51 X

*Primary Examiner*—Allen M. Ostrager
*Assistant Examiner*—Stephen F. Husar
*Attorney, Agent, or Firm*—K. Maxwell Hill

[57] ABSTRACT

The specification describes a Rankine cycle power plant of the single stage type energized by gasified freon, the latter being derived from freon in the liquid state in a boiler provided in the form of a radio frequency heating cell adapted at low energy input to effect a rapid change of state from liquid freon at a given temperature and pressure to gaseous freon of relatively large volume, thereby to drive a Rankine cycle type of engine recognized in the prior art as a steam engine type of engine of the piston or turbine type.

4 Claims, 2 Drawing Figures

SINGLE STAGE RANKINE AND CYCLE POWER PLANT

BACKGROUND OF THE INVENTION

1. Brief Description of the Invention

This invention relates to a single stage Rankine cycle power plant characterized by a gasifiable liquid of the freon type to which heating energy is supplied in a boiler by a radio frequency heating technique to effect an effectively instantaneous or rapid control of the generation of energized gases utilized in driving a Rankine engine.

2. State of the Prior Art

Within this specification will be used the term Rankine engine which term is intended to describe any and all types of engines capable of being operated by steam energy. In the present invention however, gas energy derived from heated liquid freon is employed in place of steam. In a most general way, the heating of liquid freon to drive an engine is described in the prime mover system of U.S. Pat. Nos. 3,636,706 and 3,750,393. Attempts to utilize the advantages characteristic of a substance such as freon in the driving of a Rankine cycle have resulted in workable apparatus characterized by a relatively large time constant in the accelerating characteristics as well as a relatively low efficiency in the application of heat to liquid freon to raise the same to boiling or desired vaporizing temperature thereby to generate a usable gas at desired pressures and temperatures.

OBJECTS OF THE INVENTION

It is an object of the present invention to provide a boiler structure for a freon driven Rankine cycle engine characterized by a cell containing the liquid freon and the gaseous products thereof as a result of radio frequency energization of the liquid freon.

It is another object of the invention to provide a liquid boiler for freon and like liquid materials in the form of a radio frequency cell adapted to contain a liquid to a level providing in said cell an expansion space for the gaseous state of said liquid.

It is another object of the invention to provide a single stage Rankine cycle power plant adapted to be utilized as a prime mover system characterized by a closed energy circuit having no products of exhaust or exhaust noise and adapted to utilize the calorific value of ambient or surrounding air as a source of energy for the driving of said cycle.

DETAILED DESCRIPTION OF THE DRAWINGS

Figure 1:
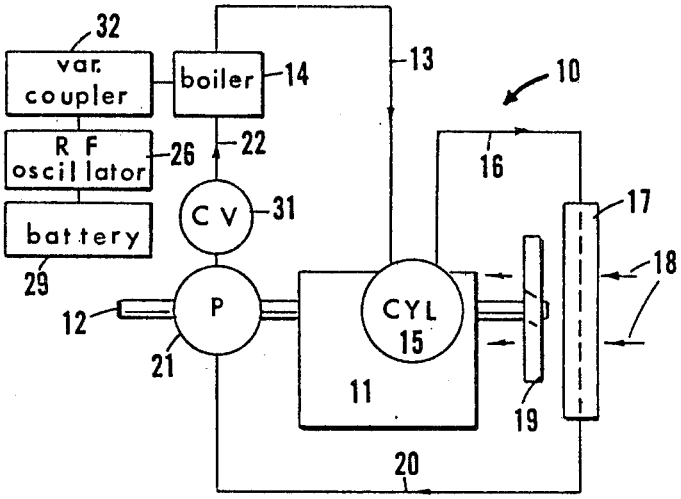
FIG. 1 is a schematic diagram of a Rankine engine of a single stage type assembled in a power plant circuit with a freon boiler of the invention.

The general outline of the schematic for a closed circuit steam power plant will be recognized in FIG. 1, but wherein two major differences will become apparent as the description proceeds.

The power plant 10 comprises a single stage Rankine cycle 11, as for example in the most simple terms, a single cylinder steam engine having an output power shaft 12. The inlet line 13 communicating gaseous energy from boiler 14 is valved at the power cylinder 15 in the conventional Rankine cycle manner to allow high pressure gases in the case of the present invention instead of high pressure steam to drive the piston of said cylinder on a downstroke to effect rotation of shaft 12. The exhaust line 16 on cylinder 15 on the upstroke of the piston thereon and having regard to associated conventional exhaust valves and gears communicating low pressure gases to a condensor 17 provided generally in the form of a heat exchanger for example of the honeycomb radiator heat exchanger type utilized as a radiator in an automobile and adapted to communicate air 18 at ambient or surrounding temperature and pressure therethrough under the action of the fan 19 driven by shaft 12 and preferably directing heated air over at least cylinder 15. A relatively modest temperature drop in the low pressure gases effects liquifaction thereof for communication through return line 20 to high pressure pump 21 driving the liquid medium for delivery to boiler 14 through line 22.

As a first difference compared to steam operation of a Rankine and cycle engine the condensor 17 is subjected to a forced air draft as determined by the operation of fan 19. Furthermore, the power plant of the invention is not necessarily intended to be stationary thus for example, where the power plant is moving at relatively high velocity in cool air as compared with hot air substantial efficiency benefits can be derived indicating that the heat exchanger 17 is intended to be larger and to accommodate a larger throughput of air to higher temperatures as compared with that size of structure required at lower air temperatures.

Figure 2:
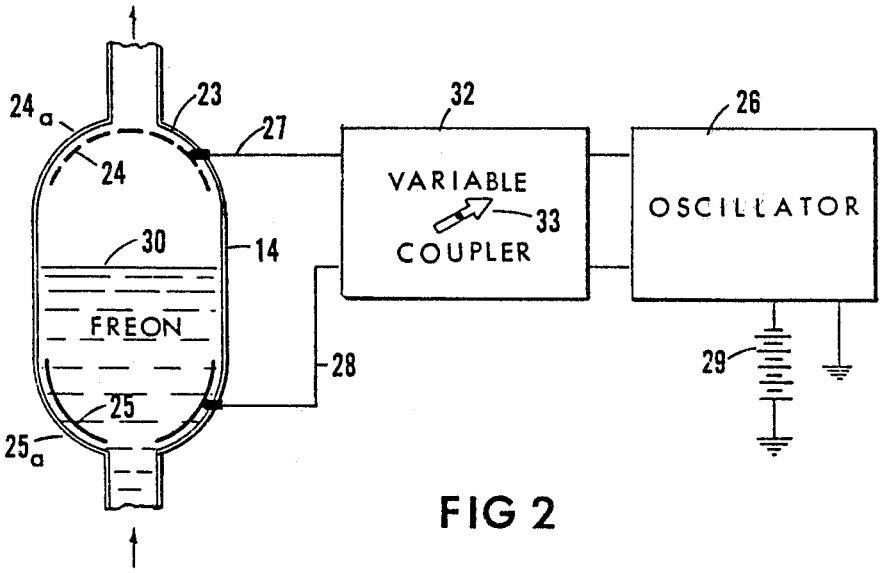
FIG. 2 is a sectional diagram of the boiler of the invention.

The boiler 14 as shown in more detail in FIG. 2, and comprising an outer high pressure casing 23 preferably of stainless steel carrying therewithin in spaced insulated manner, the open grid array tungsten cathode mesh 24 at the upper end **24*a* opposite to tubular anode cup 25 at the lower end 25*a* of the boiler 14 and connected to the radio frequency oscillator 26 by radio frequency lines 27–28 respectively, the said oscillator being energized by a battery source 29. As indicated in this Figure, freon liquid is adapted to rise to the level 30 within said boiler 14** to be energized by radio frequency energy of the order of 24 megacycles at 1000 volts potential.

The residual freon vapors or gases in the boiler at any time are sufficient to act as an initiating gas for the gas discharge effect enabling the conduction of radio frequency energy, this characteristic of freon gas being sufficient in the residence of the invention to be fortuitous in this respect depending upon the particular type of freon used. The voltage suggested as 1000 volts may be different for different freon liquids to effect a striking of radio frequency conduction.

A conventional pressure adjustable check valve 31 is preferably included between the pump 21 and boiler 14 especially in cases where the boiler is of somewhat minute physical size as compared with the boiler structure demanded for the driving of a Rankine engine by a water boiler. In the present invention the boiler structure may be of a weight considerably less than that of the engine it energizes.

In the driving of turbine engines the number of stages necessary for efficient operation by steam energy may be markedly reduced when utilizing freon gas energy.

The radio frequency coupler 32 connecting the oscillator to the cathode and anode of the boiler is a conventional high current radio frequency coupler adapted to be adjusted by the control 33 thus providing a means of adjusting the radio frequency energy input to the boiler to effect a control of the speed of operation of the Rankine engine at a particular load.

What is claimed is:

1. An improved Rankine cycle power plant of the freon gas energy type and comprising a Rankine engine having a gas energy inlet line and an exhaust line and a power output shaft for said engine;

a freon boiler having an upper cathode grade and a lower end element spaced therefrom, said anode being substantially immersed in liquid freon in said boiler, and gaseous energy inlet line of said engine communicating to said boiler above the liquid freon level therein; a radio frequency oscillator and a battery source energizing same and means communicating radio frequency energy from said oscillator to said cathode and anode; an air communicating heat exchanger adapted to conduct exhaust gases from said exhaust line for liquification of said gases in said heat exchanger; a liquid pump driven by said power output shaft and delivering liquified gases from said heat exchanger to said boiler at the pressure of said boiler at least; and a fan driven by said power output shaft adapted to draw ambient air through said heat exchanger.

2. The power plant of claim 1 in which the fan is positioned to direct air from said heat exchanger to said Rankine engine.

3. The power plant of claim 1 and a check valve between said pump and said boiler.

4. The power plant of claim 1 and means for controlling the delivery of radio frequency energy to said boiler.

* * * * *